US005114149A

United States Patent [19]

Bailey

[11] Patent Number: 5,114,149

[45] Date of Patent: May 19, 1992

[54] DISTANCE MARKER WITHIN A GOLF COURSE FAIRWAY

[76] Inventor: John M. Bailey, 1249 Golfside Dr., Sebring, Fla. 33870

[21] Appl. No.: 773,222

[22] Filed: Oct. 9, 1991

Related U.S. Application Data

[63] Continuation-in-part of Ser. No. 672,174, Mar. 20, 1991, Pat. No. 5,072,940.

[51] Int. Cl.[5] ..... A63B 67/02; G09F 7/22; E01F 9/02

[52] U.S. Cl. ..... 273/176 A; 40/608; 52/103; 273/176 L; 273/32 H; 116/209; 404/11

[58] Field of Search ..... 273/176 L, 176 F, 176 FA, 273/176 FB, 176 G, 176 H, 176 J, 176 R, 176 A, 176 AA, 176 AB, 32 H, 32 R; 40/608; 116/209; 52/103, 104, 105; 404/10, 11

[56] References Cited

U.S. PATENT DOCUMENTS 2,774,323 12/1956 Kirk ..... 404/10 X
3,362,305 1/1968 Pellowski ..... 404/10
4,696,134 9/1987 Neaume ..... 52/103
4,862,823 9/1989 Hughes ..... 40/608 X

*Primary Examiner*—George J. Marlo

[57] ABSTRACT

A visual distance marker for a golf course fairway which provides viewable indicia of distance along the fairway such as from a tee. The device includes an elongated resilient maker strip having its lower end secured inside a tubular anchor portion. When the anchor portion is embedded or buried in the ground, the marker strip is supported in an upright orientation extending above the ground but is loosely secured inside the tubular anchor portion so that the marker strip can be rotated about its longitudinal axis through a small acute angle. The marker strip is thin and sufficiently resilient in one plane so as to be deflected and bent over against the ground as a reel-type lawn mower approaches and passes thereover, thus eliminating the need for removing and replacing the device during normal mowing operations.

3 Claims, 3 Drawing Sheets

DISTANCE MARKER WITHIN A GOLF COURSE FAIRWAY

BACKGROUND OF THE INVENTION

This is a continuation-in-part of application Ser. No. 07/672,174 filed Mar. 20, 1991, now U.S. Pat. No. 5,072,940.

This invention relates generally to viewable marking devices, and more particularly to a resilient viewable distance marker for use in golf courses along the length of a fairway.

Knowing the distance of a golf ball from a particular position on a fairway after being struck from a tee is quite important in the game of golf. This information not only provides the golfer with feedback as to the length of his initial drive from the tee, but also provides immediate information as to the distance from ball placement to the green of that particular fairway. When it is likely that, on the golfer's next shot, he will reach the green, this information becomes of even more importance.

One device known to applicant which serves this function is in the form of a concrete disc buried in the ground flush with the ground's surface so that mowing machines may pass thereover without damage. Other objects used for this purpose are stakes or shrubbery planted on each side of the fairway in the rough away from normal mowing operations.

These above devices are unsatisfactory for their intended use. The concrete discs are difficult to see from any distance and typically result in delay of the game as a player searches for the marker. Likewise, shrubbery and stakes planted in the rough are often damaged or knocked down despite careful mower operator avoidance maneuvers.

Applicant is also aware of one prior art device disclosed in U.S. Pat. No. 3,067,717 to Imparato which teaches a portable resilient marker having a coiled spring member positioned just above the ground level as a lower extension thereof is embedded in the ground. However, this device would clearly become damaged or destroyed the first time that a fairway mower passes over it. Therefore, this device would require removal during normal mowing operations.

Based upon the prosecution of the above-referenced application, applicant is also aware of the following references which were cited during that prosecution:

| | |
|---|---|
| Kirk | 2,774,323 |
| Pellowski | 3,362,305 |
| Neaume | 4,696,134 |
| Hughes | 4,862,823 |

However, none of these references perform a function or have structure which is similar to that of the present invention.

Confronted with this problem, and being aware that a reel-type mower in either single or gang form is used for fairway mowing, the present invention is intended to provide a device which clearly satisfies this need and takes advantage of the inherent structural features of these reel-type mowers. A visual distance marker is provided which is embedded or buried within the ground on the fairway having an upwardly extending marker strip which is of sufficient width when placed generally transversely to the length of the fairway so as to be viewable by a golfer from a significant distance there from. Additionally, the marker strip, being resilient in one direction because of its thinness, will be resiliently deflected downwardly against the ground as the mower is passed thereover and then returning to its generally upright position thereafter without damage or the need for removal.

BRIEF SUMMARY OF THE INVENTION

This invention is directed to a visual distance marker for a golf course fairway which provides viewable indicia of distance along the fairway such as from a tee. The device includes an elongated resilient marker strip connected at its lower end to an enlarged tubular anchor portion at its lower end. When the anchor portion is embedded or buried in the ground, the marker strip is supported in an upright orientation extending above the ground. The marker strip is thin and sufficiently resilient in one plane so as to be deflected and bent over against the ground as a reel-type lawn mower approaches and passes thereover, thus eliminating the need for removing and replacing the device during normal mowing operations. The lower connection between marker strip and anchor provides significant additional resiliency and movement of the marker strip.

It is therefore an object of this invention to provide a visual distance marker for golf course fairways which may be embedded or buried in the ground without the need for removal during normal mowing operations.

It is yet another object of this invention to provide a visible distance marker for golf course fairways which is easily viewable from a considerable distance so that it may quickly located during normal golf play.

It is yet another object of the above invention to be economical to manufacture and easily deployable into the fairway at any desired location.

It is yet another object of this invention to provide an upright viewable indicia strip which bears distance indicia either from a golf tee and/or to the next associated green or hole.

It is still another object of this invention to provide a visible distance marker for golf course fairways which will resiliently deflect and return to an upright position regardless of the angle of fairway mowing.

In accordance with these and other objects which will become apparent hereinafter, the instant invention will now be described with reference to the accompanying drawings.

DETAILED DESCRIPTION OF THE INVENTION

Figure 1:
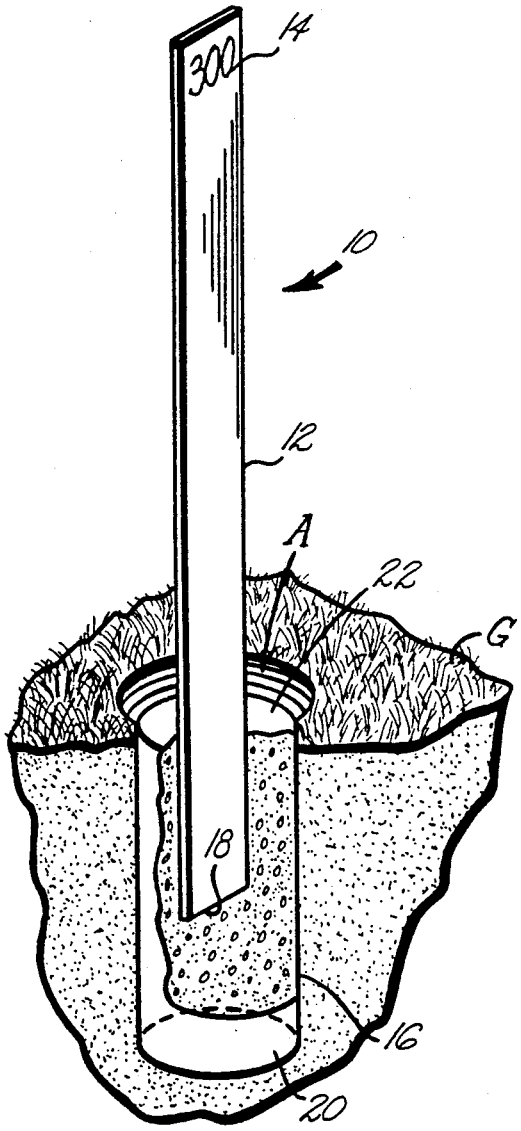
FIG. 1 is a perspective broken view of one embodiment of the invention deployed in the ground.

Referring now to the drawings, and particularly to FIG. 1, one embodiment of the invention is shown generally at numeral 10 and includes an elongated, thin rectangular marker strip 12 fabricated of resilient stainless steel having an upper viewable surface 14 and a lower end 18 which is embedded in a formed cylindrical anchor of concrete 16. The distance marker 10 is shown embedded or buried in the ground so that the upper end 22 of concrete anchor 16 is slightly below the surface of the ground forming cavity A thereabove to reduce the severity of flexible bending required of the marker strip 12 caused by a lawn mower passing thereover as will be described herebelow.

Although marker strip 12 may simply be of a width sufficient to be seen from a distance, the upper surface 14 facing the length of a fairway may also include distance indicia printed thereon providing further information to a golfer as to its position both from the tee and from the upcoming green. However, the preferred indicia is a color coding of each entire marker strip 12 whereby a particular uniform color, eg. blue, represents a particular distance, eg. 200 yards from the tee. This color coding would be consistent throughout each golf course.

Figure 2:
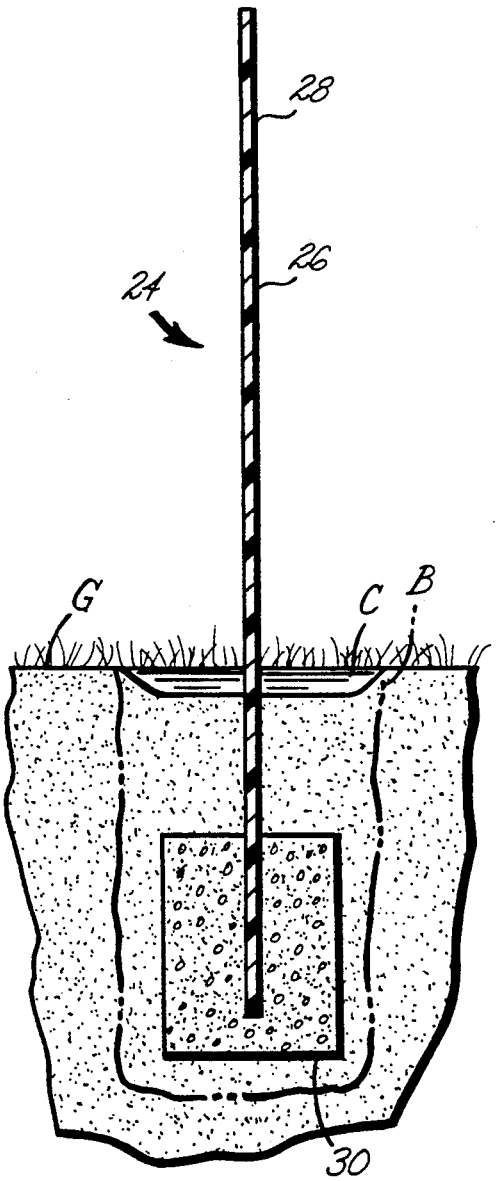
FIG. 2 is a side elevation section view of a modified form of the invention as shown in FIG. 1.

Referring to FIG. 2, an alternate embodiment is shown generally at numeral 24 having a thin plastic upstanding marker strip 26 with an exposed upper flat surface 28 for viewing and/or for bearing written distance indicia as previously described thereupon. A molded anchor 30 formed of concrete is provided into which the lower end of marker strip 26 is firmly embedded. This concrete anchor 30 is somewhat shorter in overall height so that, when buried beneath the ground G into filled hole B, a layer of ground covers the upper end of anchor 30. A pocket C is still useful and should be provided in the form of a cup-shaped recess below the ground surface G to reduce the severity of flexible resilient deformation of marker strip 26 required during lawn mower passage thereover.

Figure 3:
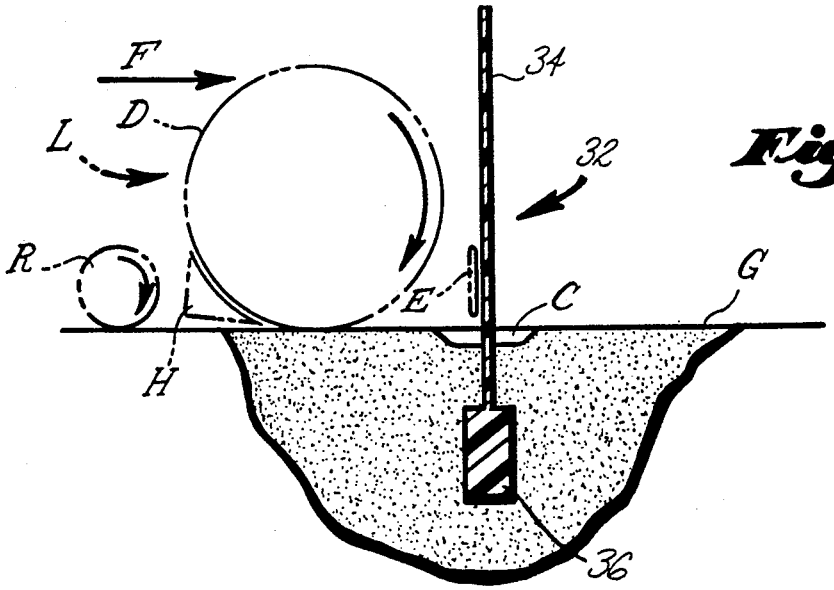
FIG. 3 is a side elevation section view of another embodiment of the invention showing the approach of a reel-type lawn mower shown schematically in phantom.
Figure 4:
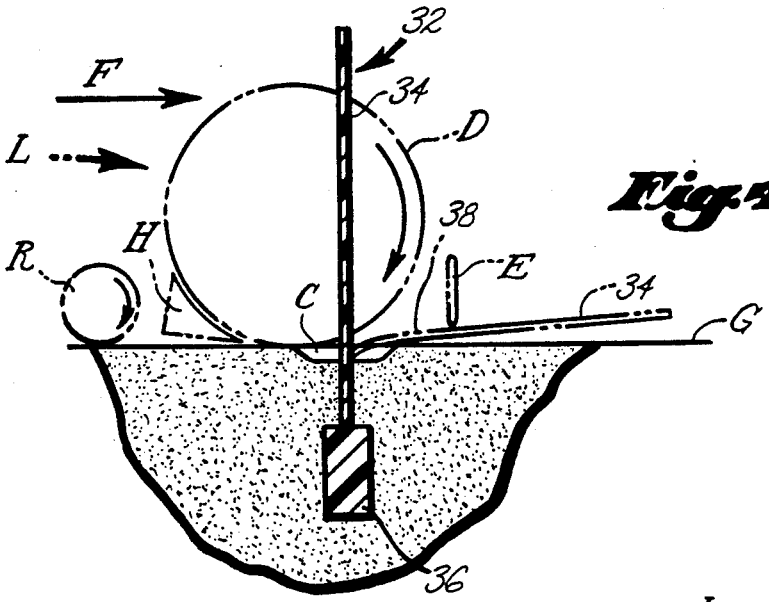
FIG. 4 is a view similar to FIG. 3 as the lawn mower progresses over the invention shown deflected in phantom.
Figure 5:
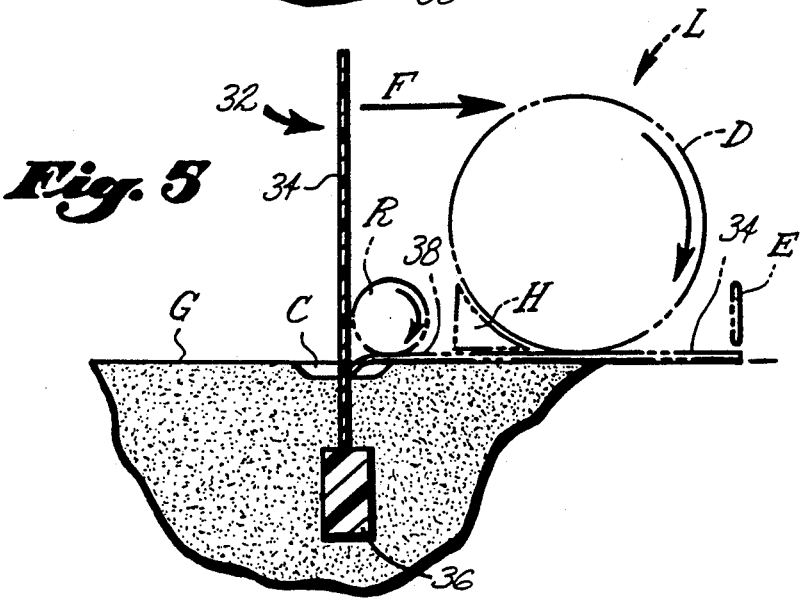
FIG. 5 is a view similar to FIG. 3 showing the lawn mower having progressed fully over the invention shown in phantom.

Referring now to FIGS. 3, 4 and 5, yet another and preferred embodiment of the invention is shown generally at 32. This embodiment 32 is integrally molded of resilient plastic or polyethylene material having an upstanding marker strip 34 of a width sufficient to be viewed by a golfer and sufficiently thin so as to accomplish the resilient deformation required of it during passage of a lawn mower thereover as depicted in these figures.

Integrally molded at the lower end of marker strip 34 is an enlarged anchor portion 36 also formed of molded plastic or polyethylene material. This anchor portion 36, as has been previously described, when buried in the ground, securely holds and orients the marker strip 34 in an upright position with respect to the surface of the ground upwardly extending therefrom for viewing.

As in all embodiments of the invention, this embodiment 32 is structured so that the anchor portion 36 is embedded in the ground and that the marker strip 34 extends in upright fashion above the ground a distance sufficient so as to interact with a reel-type lawn mower L shown in phantom as will be described herebelow. It is preferred that the deployment of these devices include forming a cup-shaped pocket or depression C below the grade level G surrounding the marker strip 34 as it exits the ground. This pocket C is for the purpose of reducing the severity of pliable or resilient deformation required of the marker strip 34 as the lawn mower L passes thereover.

Typically, the mowing of grass on a fairway is accomplished by the lawn mower L moving in a set pattern lengthwise to the fairway. This arrangement is ideally suited for installation of the present invention in that the width of each marker strip is oriented transversely thereto so as to be optimally viewable by golfers and ideally oriented to be deflected as shown in FIGS. 3, 4 and 5. Virtually all lawn mowers used on golf course fairways are of a reel-type, the reel D having a plurality of spiral-wound bars or blades which rotate in the direction of the arrow and act against cutter bar H to shear the grass. A following roller R is used to stabilize the mower and to control the height of cutter bar H above the ground G.

In FIG. 3, the lawn mower L moving in the direction of arrow F, is just about to contact the marker strip 34 by engagement with the leading edge bar E of the lawn mower L.

As seen in FIG. 4, the lawn mower L has partially passed over the device 32 so as to have deflected the marker strip shown in phantom at 34 downwardly almost fully against the ground G. The maximum flexure occurs in region 38 and it should be now more evident as to the usefulness of cup C formed into the ground for reducing the severity of the deflection in this region. In FIG. 5, the lawn mower L is fully atop the marker strip 34 shown in phantom, with roller R causing the maximum deformation of marker strip 34 in region 38.

After the lawn mower L has fully passed over and beyond the deflected marker strip 34, it will resiliently return to its upright position shown in solid in FIGS. 3, 4 and 5.

Although the preferred material for manufacturing the present invention is in the form of flexible polyethylene or the like, other materials such a metallic strip of thin heat-treated stainless steel will serve equally well and is intended to be within the scope of the present invention.

Again it is stressed that the present invention having a width of the marker strip sufficiently broad so as to be viewable also is of a sufficiently thin thickness so as to be deflected in a fashion described in FIGS. 3, 4 and 5 and to thereafter resiliently return to an upright orientation after the lawn mower passes thereover. Although the length of the marker strip above the surface of the ground G is somewhat variable, it must be of a sufficient length above the ground from the lower embedded anchor so as to avoid being drawn into the rotating spiral blades of the reel of the lawn mower. Otherwise, the device would be sheared just as a blade of grass.

Figure 8:
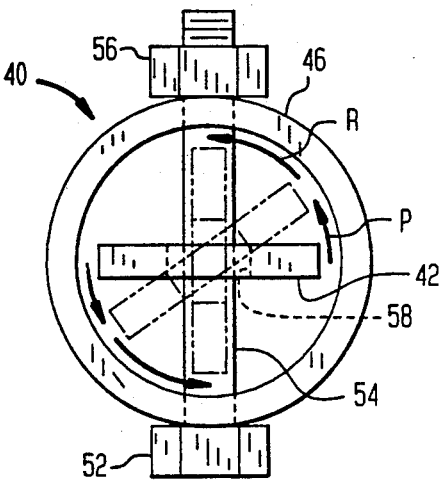
FIG. 8 is a top plan view of FIG. 6.
Figure 6:
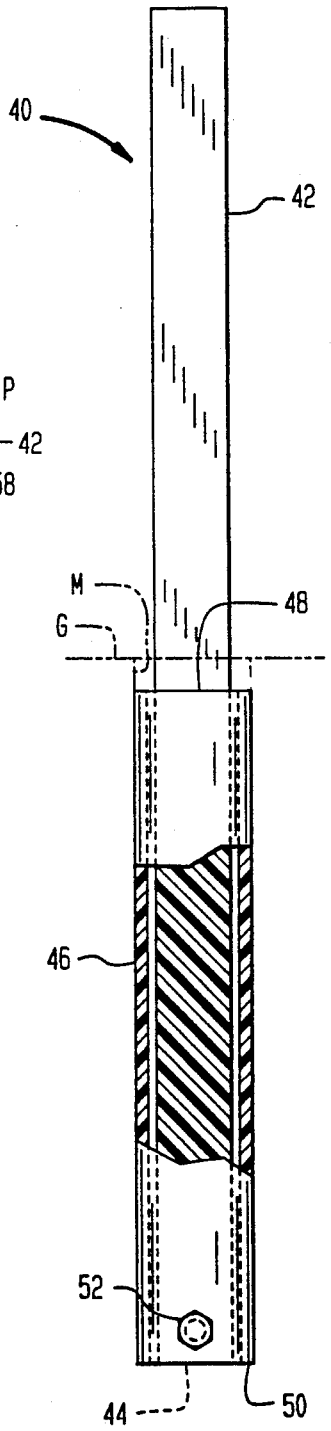
FIG. 6 is a side elevation partially broken view of the preferred embodiment of the invention.
Figure 7:
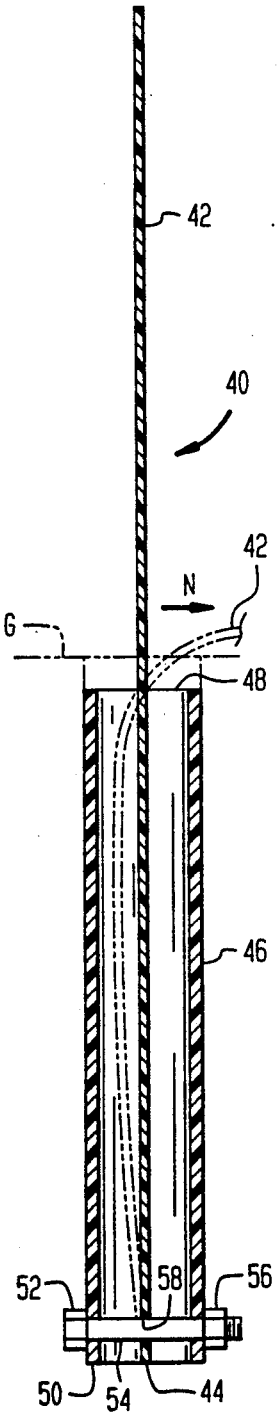
FIG. 7 is a vertical section view through the invention as shown in FIG. 6.

Referring now to FIGS. 6, 7 and 8, the preferred embodiment of the invention is shown generally at numeral 40 and includes an elongated uniform-section, relatively thin marker strip 42 connected in upstanding orientation within a plastic or p.v.c. cylindrical tube 46. The marker strip 42 is connected having its lower end 44 generally in alignment with the lower end 50 of anchor tube 46 by passing a bolt 52 through aligned holes in the side walls of tube 46 and also passing through hole 58 adjacent the lower end 44 of the marker strip 42. Nut 56 is threadably engaged onto bolt shaft 54 to retain this arrangement.

Hole 58 is preferably slightly larger than the outside diameter of bolt shaft 54 so that, as best seen in FIG. 8, marker strip 42 will freely rotate from its at rest position shown in solid through angle P to an initial alternate at rest position shown acutely in phantom. Further rotational deflection of the exposed portion of marker strip 42 is also facilitated by its thin, resilient nature allowing for additional twist in the range of angle R so that the exposed portion of marker strip 42 will freely angularly rotate through in the range of 90 degrees from its normal at rest position.

This angular or twisting characteristic of embodiment 40 is provided in situations where the fairway mowers traverse the fairway at different directions during each mowing cycle. This is typically done in a criss-cross fashion so as to maintain a more even fairway surface. In such a situation, therefore it is impossible to orient a marker strip so as to always have its broad surface facing the direction of mowing. This embodiment 40 accommodates this eventuality by freely allowing the marker strip 42 to rotate as well as to be deflected downwardly as shown in phantom in FIG. 7 wherein the mower is moving in the direction of arrow N.

By having the bolt connection positioned adjacent the lower ends of marker strip 42 and anchor tube 46, the severity of the bend required of marker strip 42 in the vicinity of the ground surface G is also lessened because the portion of marker strip 42 contained within the anchor tube 46 also flexes as shown in phantom.

It is recommended that this embodiment 40 be installed into a fairway by first drilling a hole M slightly deeper than the length of anchor tube 46 so that the upper end 48 will be positioned slightly below the ground surface G.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A visual distance marker for a golf course which is implanted in an elongated fairway of a golf course and is unaffected by the operation of a reel-type lawn mower passing thereover, said marker comprising:

a very thin, flat, generally straight flexible upstanding marker strip having an upper distal end and a lower end and a uniform generally rectangular cross section along substantially its entire length;

said marker strip lower end connected to an enlarged anchor portion, said anchor portion completely embedded into a grassy area of the golf course fairway;

said anchor portion including an elongated straight tubular member having a length generally in the range of less than half the length of said strip, said strip having a width slightly less than the inside diameter of said tubular member;

said strip and said tubular member connected adjacent their generally aligned lower ends by passing an elongated bolt or pin through aligned holes formed through said tubular member and said strip;

said upper end extending above ground a distance such that said strip may be initially depressed by the leading edge bar of the lawn mower and said strip will be subsequently depressed by the mower and rolling bar of the mower, so that said strip will not be severed when the grassy area of said fairway is being mowed in a direction lengthwise or diagonally across said fairway;

said strip marker being oriented in the fairway so that its width or greatest transverse dimension faces the direction of the tee associated with said fairway, and being sufficiently resilient to return to its original straight and upstanding orientation thereafter;

indicia on the width portion of said marker strip for communicating to a golfer the distance of said strip from said tee associated with said fairway to enable a golfer to determine the distance a golf ball lying along the length of the fairway has been driven from said tee.

2. A visual distance marker as set forth in claim 1, further comprising:

indicia applied to one surface of said marker strip representing a distance along the length of the fairway.

3. A visual distance marker as set forth in claim 1, wherein: said hole in said strip is slightly larger than the diameter of said bolt or pin whereby said strip will rotate freely with respect to said tubular member back and forth from an at-rest position through a small acute angle.

* * * * *